US007421971B1

(12) United States Patent
Vespoli

(10) Patent No.: US 7,421,971 B1
(45) Date of Patent: Sep. 9, 2008

(54) ROWING SHELL SHOE SYSTEM

(75) Inventor: Michael Vespoli, Guilford, CT (US)

(73) Assignee: Vespoli, USA, New Haven, CT (US)

( * ) Notice: Subject to any disclaimer, the term of this patent is extended or adjusted under 35 U.S.C. 154(b) by 531 days.

(21) Appl. No.: 11/105,123

(22) Filed: Apr. 13, 2005

(51) Int. Cl.
*B63B 17/00* (2006.01)

(52) U.S. Cl. ..... 114/363; 441/70

(58) Field of Classification Search ..... 114/363; 441/70

See application file for complete search history.

(56) References Cited

U.S. PATENT DOCUMENTS

| | | | | |
|---|---|---|---|---|
| 421,080 | A * | 2/1890 | Kerns | 114/363 |
| 5,181,332 | A * | 1/1993 | Uren et al. | 36/114 |
| 2004/0058102 | A1 * | 3/2004 | Baychar | 428/34.1 |

OTHER PUBLICATIONS

The prior art rowing shoe shown in the photograph has an injection-molded plastic toe portion secured to a dimpled rubber sole, which in turn is adhered to a paper-type inner sole. The plastic toe portion has screw holes to secure the shoe to a footboard in the rowing shell.

* cited by examiner

*Primary Examiner*—Sherman Basinger
(74) *Attorney, Agent, or Firm*—DeLio & Peterson, LLC; Peter W. Peterson

(57) ABSTRACT

A rowing shoe system for use by a rower in a racing boat has a footboard adapted to be secured in a boat, a pair of shoe liners and a pair of shoe shells. The pair of shoe liners are sized to receive the feet of a rower, are made out of anti-microbial material, and have a flexible exterior surface and a flexible interior surface configured to fit over substantially the entire foot of the rower. The pair of shoe shells are detachably securable to the footboard in a rowing position and have an interior sized to receive the flexible shoe liners. The shoe shells have openings therein to ventilate the rower's feet, and the shoe liners are removable from the shoe shells. The rowing shoe system may include a plurality of pairs of shoe liners of different foot sizes.

18 Claims, 2 Drawing Sheets

ROWING SHELL SHOE SYSTEM

BACKGROUND OF THE INVENTION

1. Field of the Invention

The present invention relates to a rowing shoe system for use by a rower in a racing shell and a method of securing a rower's feet in such racing shell.

2. Description of Related Art

Rowing shells used in racing employ rowing shoes fixed to a footboard to secure the rower's feet to the boat. This system enables maximum force to be exerted as the rower drives the oars. Shoe systems used in racing shells typically use conventional lined shoes that absorb water from splashing and perspiration. Even after drying for an extended period of time, traditional rowing shoes hold as much as 25% of their weight in water.

Unless the entire shoe is replaced after each race, rowers are therefore faced with using soggy shoes, which is not hygienic. Moreover, if rowers change boats or position within a boat, they must either change the shoe at their rowing position, or use a shoe that does not necessarily fit their foot properly. Additionally, typical prior art rowing shoes have two-piece soles that often become misaligned, leading to awkward foot position.

Accordingly, there is a need for an improved rowing shoe system for use in racing shells and other such boats.

SUMMARY OF THE INVENTION

Bearing in mind the problems and deficiencies of the prior art, it is therefore an object of the present invention to provide an improved rowing shoe system, and method of securing a rower's foot in a rowing shell.

It is another object of the present invention to provide a rowing shoe system that is comfortable while still being more durable and water resistant than in the prior art.

A further object of the invention is to provide a rowing shoe system that reduces the need to change shoes at each rowing position while still providing a firm fit and positive feel for the rower through the drive stroke.

It is yet another object of the present invention to provide a rowing shoe system that provides better foot hygiene.

Still other objects and advantages of the invention will in part be obvious and will in part be apparent from the specification.

The above and other objects, which will be apparent to those skilled in the art, are achieved in the present invention which is directed to a rowing shoe system for use by a rower in a racing boat comprising a footboard adapted to be secured in a boat, a pair of shoe liners and a pair of shoe shells. The pair of shoe liners are sized to receive the feet of a rower, and have a flexible exterior surface and a flexible interior surface configured to fit over substantially the entire foot of the rower. The pair of shoe shells are detachably securable to the footboard in a rowing position and have an interior sized to receive the flexible shoe liners. The shoe shells have openings therein to ventilate the rower's feet, and the shoe liners are removable from the shoe shells. The rowing shoe system may include a plurality of pairs of shoe liners of different foot sizes.

The shoe shells have an opening of sufficient size to receive the shoe liners when on the rower's feet, with the opening further including a securable closure to prevent removal of the shoe liners when on the rower's feet. Preferably, the shoe shells are adjustable in size to accommodate shoe liners of different foot sizes. The shoe shells have a heel portion with an adjustment strap to accommodate shoe liners of different foot sizes. More preferably, the shoe shells have a water-impermeable toe and top portions, and further include an adjustable heel portion to accommodate shoe liners of different foot sizes. The shoe shells may have a one-piece sole.

In another aspect, the present invention is directed to a method of securing a rower's feet in a racing boat comprising providing a boat having a footboard and a pair of shoe shells secured to the footboard in a rowing position. The shoe shells have an interior sized to receive flexible shoe liners and openings therein to ventilate the rower's feet. There is also provided a pair of shoe liners sized to receive the feet of a rower. The shoe liners have a flexible exterior surface and a flexible interior surface configured to fit over substantially the entire foot of the rower. The method then includes placing the shoe liners on the rower's feet and inserting the rower's feet, with the shoe liners on, into the shoe shells. The method may further include removing the rower's feet, with the shoe liners on, from the shoe shells; and removing the shoe liners from the rower's feet. The method may also include providing a plurality of pairs of shoe liners of different foot sizes, and selecting shoe liners of the rower's foot size prior to placing the shoe liners on the rower's feet.

The shoe shells may have an opening of sufficient size to receive the shoe liners when on the rower's feet, with the opening further including a securable closure, and the method may further include securing the closure after inserting the rower's feet into the shoe shells to prevent removal of the shoe liners when on the rower's feet.

The shoe shells may be adjustable in size, and the method may further include adjusting the shoe shell to accommodate the rower's foot size after inserting the rower's feet into the shoe shells. Also, the shoe shells may have a heel portion with two (2) adjustment straps, and the method may include adjusting the straps to the rower's foot size after inserting the rower's feet into the shoe shells.

Preferably, the shoe shells are substantially hydrophobic, have a one-piece sole and have greater rigidity than the shoe liners. The shoe liners preferably have a slip-resistant exterior sole surface.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-4 of the drawings in which like numerals refer to like features of the invention.

Figure 1:
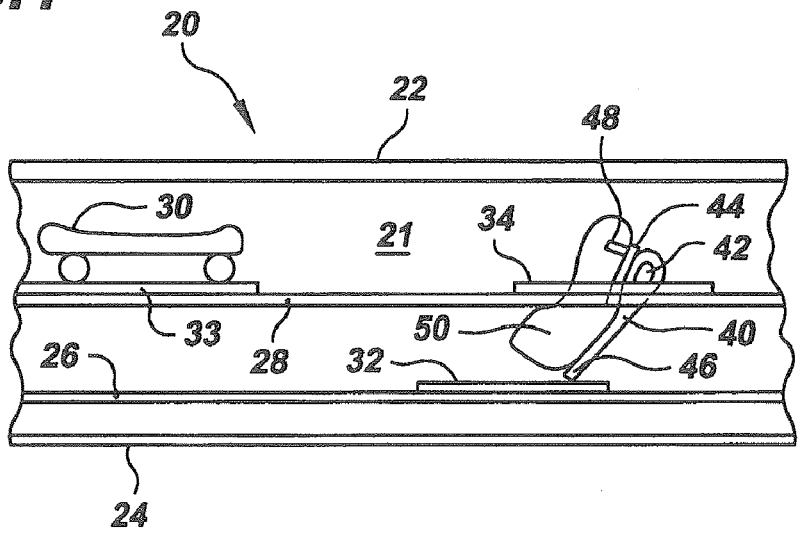
FIG. 1 is a side a side elevational view, partially cut away, of the preferred rowing shoe system of the present invention mounted in a racing shell.

FIG. 1 depicts the preferred embodiment of the rowing shoe system mounted at a seating position in a typical racing boat or shell 20. Hull 21 has at its top gunwale 22 and at its bottom keel 24. Secured within the hull over the keel is a lower liner 26, and above that an upper liner 28. Upper liner 28 has a central opening to permit the rower's legs to extend from seat 30, mounted on rollers on track 33, to footboard 40. Footboard 40 has pivot 42 at its upper end adjustably secured to track 34 and mount 46 at its lower end adjustable secured to track 32 on lower liner 26. Footboard 40 is sufficiently wide to secure a pair of the shoe shells 50 at normal spaced width, and supports substantially the entire length of each shoe shell. Rowing shell 20 may have a one or more of such combination seat and footboard seating positions, for example, four or eight, along the length of the hull.

Figure 2:
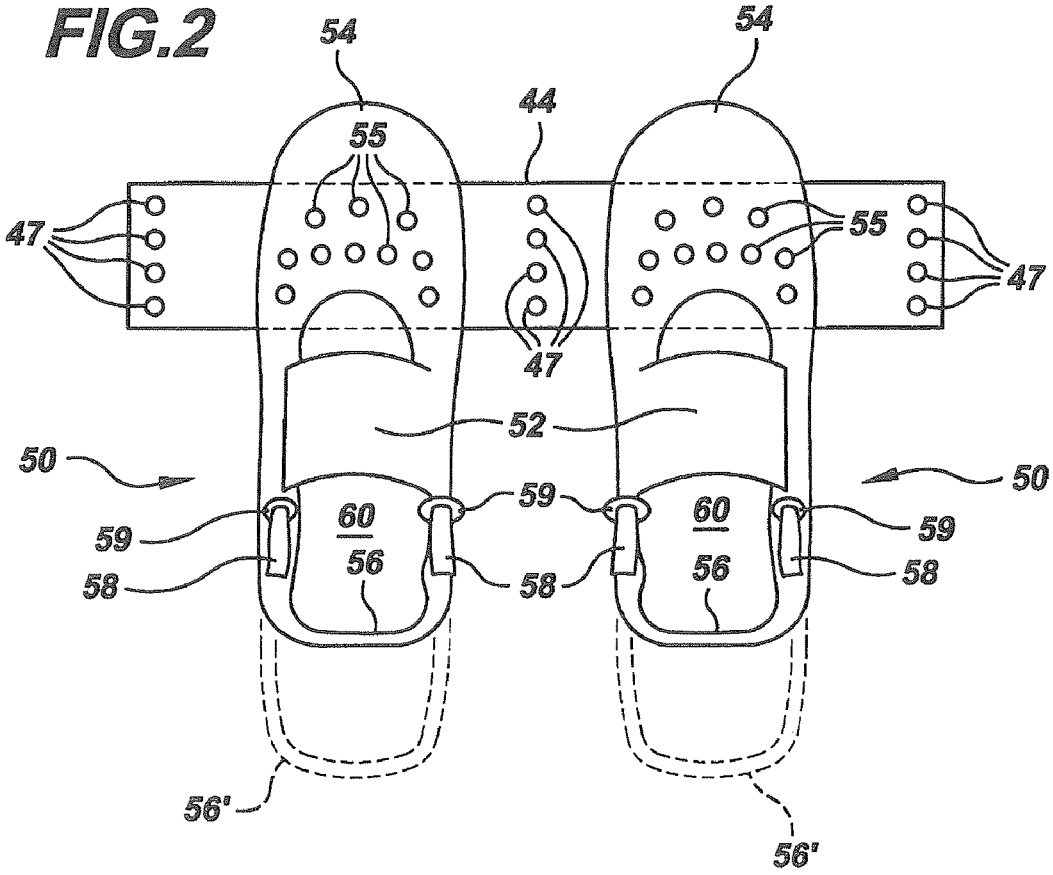
FIG. 2 is a top plan view of the rowing shoe system of FIG. 1.
Figure 3:
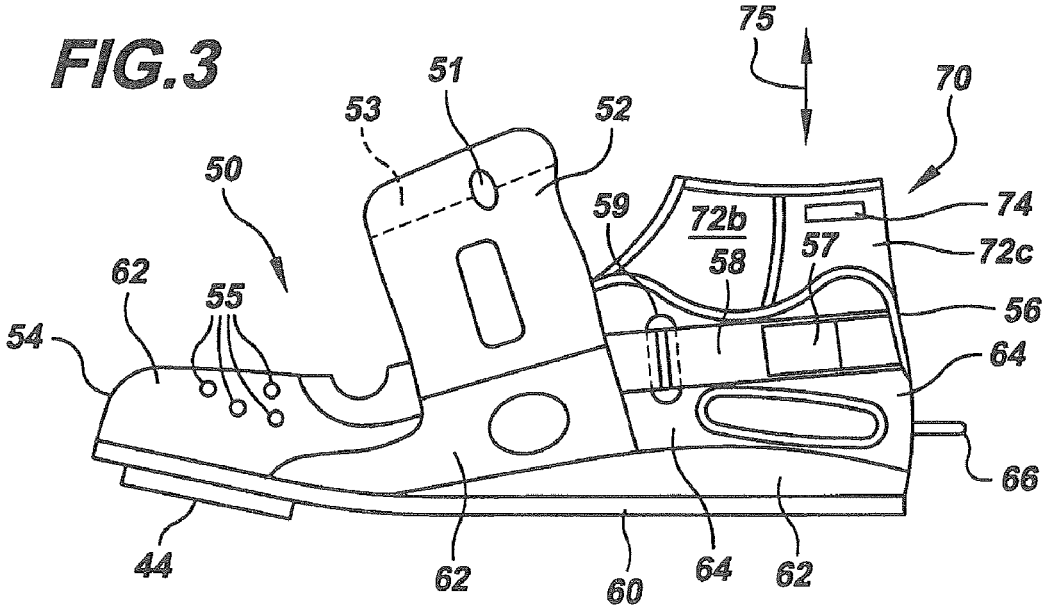
FIG. 3 is a side elevational view of one of the shoe shells of FIG. 2 with the preferred removable liner.

The preferred shoe shell of the present invention is shown in FIGS. 1, 2 and 3. Each shoe shell 50 is mounted to a rigid mounting plate 44 that is secured by a pin or fastener 48 (FIG. 1) at the center and each side of footboard 40. As shown in FIG. 2, mounting plate 44 extends transversely beneath the soles 60 of the spaced pair of shoe shells 50, near the toe portions 54. Holes 47 at the center and each end of the mounting plate 44 are provided to adjust the vertical position of the plate and shoe shell relative to pins 48 on the footboard.

A shoe shell 50 is made primarily of a substantially hydrophobic material such as flexible vinyl 62 to prevent water absorption during use, either from water splashing into the boat or from the rower's perspiration. Such vinyl or other substantially hydrophobic material 62 is used in the upper portion of the rower's foot near the toe, along the lower side portions, and in the closure strap 52. Shoe shell 50 provides a skeleton-like support for the rower's foot that resists rotting or weakening over time. Openings 55 may be provided for ventilation near the toe portion 54 and at other portions along the top or sides of the shoe shell 50. A contoured instep closure strap 52 is permanently secured at one side of shoe shell 50, and is removably secured at the other side of the shoe shell. A hook-and-loop fastening systems such as Velcro™ may be provided on all or a portion of the underside 53 of closure 52 and the mating parts of the shell top and sides. In addition to securing the foot into the shell, the fastening system permits adjustment of shoe shell 50 for width of the rower's foot. A one-piece sole 60, also made of a substantially hydrophobic material such as vinyl or nylon, provides for durability as well as positive force application by the rower's foot.

To enable one size shoe shell to accommodate more than one foot length size, the heel portion 56 of the shell is adjustable for length, 56' (FIG. 2). A stretchable, water resistant material such as neoprene fabric 64 may be used in this area. The shell heel portion preferably extends to below the rower's ankle at the foot opening. On each side of the heel portion, a strap 58 of, for example, nylon webbing, adjusts around a buckle 59 and may be secured back on itself by a hook-and-loop fastener 57 to secure the heel size adjustment at a desired position.

For safety, each shoe shell 50 also includes a safety release cord attachment fixture 51, to enable the shoe shell to be quickly opened, and a heel ring 66, for a heel tie.

Figure 4:
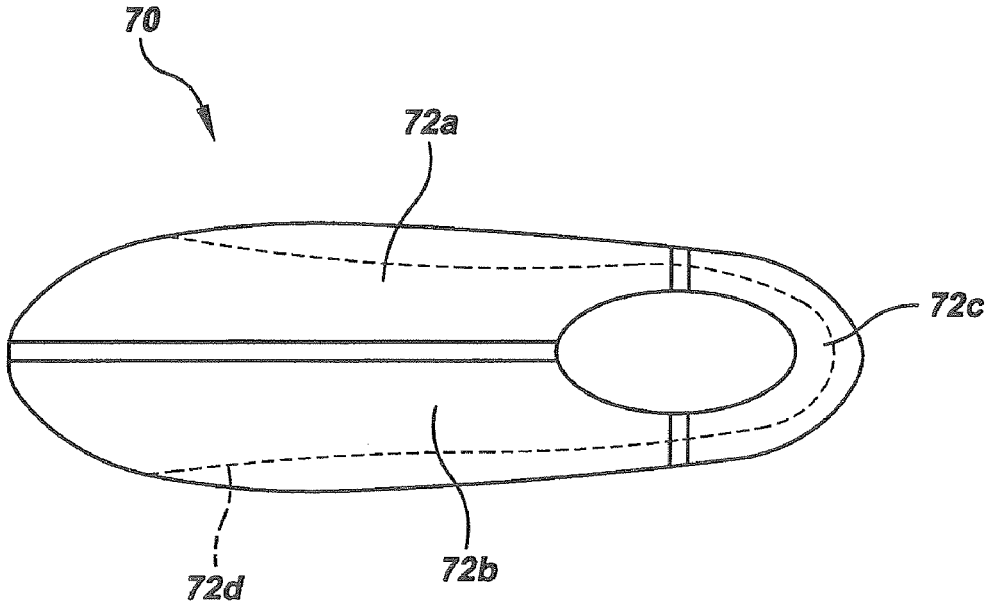
FIG. 4 is a top plan view of the removable liner of FIG. 3, out of the shoe shell.

Flexible shoe liner 70 is preferably provided to fit snugly over substantially the entire rower's foot, including the ankle. While the liner may include ventilation openings therein, preferably, the liner completely covers the rower's foot with a soft, air-permeable or breathable material such as neoprene. Liner 70 has greater flexibility than shoe shell 50 (except for any adjustable material used in the shell heel area), and may easily be inserted into and removed from shoe shell 50 in directions 75. Preferably, to reduce the number of seams, the liner is made of three upper portions, heel section 72 and front and opposite side portions 72*a*, 72*b*, sewn to each other along three seams, as shown in FIG. 4. A liner sole 72*d* is sewn along the bottom portion. The shoe liner preferably has a slip-resistant exterior sole surface to reduce slippage when inside the shoe shell. An antibacterial compound may be impregnated into the liner material for greater hygiene. A space 74 is provided at the upper portion of the liner for identification of the rower to whom the liner 70 belongs.

In use, the rowing shoe system of the present invention preferably provides a shoe shell that accommodates several shoe length sizes by its heel adjustment, and several shoe width sizes by its closure adjustment, as described above. The system also provides a plurality of shoe liners, one set for each shoe length size. After confirming that the shoe shells will accommodate his shoe size (changing them out as necessary), the rower first slips the shoe liner over his feet and subsequently inserts each of his feet with the shoe liner in place into the corresponding shoe shell. The closure strap is then wrapped over the top of the rower's foot and fastened to the shoe side portion to secure the foot within the shoe shell. After the race, the closure is unsecured, and the rower's foot and liner are removed from the shoe shell. The liner may then be cleaned or replaced before the next use.

Thus, the present invention provides a rowing shoe system in which the shoe liner is separate from the shoe shell, and is both comfortable and easily replaceable after each use. The shoe shell may then be made more durable and water resistant than in the prior art. While the liners may be provided for each foot size, the shoe shells may accommodate several different foot sizes, thereby reducing the need to change shoes at each rowing position while still providing a firm fit. The shoe shell, having a one-piece sole and of greater rigidity than the liner, provides positive force application by the rower's foot to the footboard throughout the entire oar stroke, enabling the rower to drive the boat with greater efficiency. Additional ventilation in the shoe shell, combined with the replaceable liner, provides better foot hygiene.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A rowing shoe system for use by a rower in a racing boat comprising:

a footboard adapted to be secured in a boat;

a rigid mounting plate secured to the footboard;

a pair of shoe liners sized to receive the feet of a rower, the shoe liners having a flexible exterior surface and a flexible interior surface configured to fit over substantially the entire foot of the rower; and a pair of shoe shells each having a toe portion and a heel portion, each of the shoe shells being detachably securable near the toe portion to the mounting plate in a rowing position, the heel portion of each of the shoe shells being unsecured to the mounting plate and footboard and including an adjustment strap to accommodate shoe liners of different foot sizes, the shoe shells having an interior sized to receive the flexible shoe liners, the shoe shells having openings therein to ventilate the rower's feet, the shoe liners being removable from the shoe shells.

2. The rowing shoe system of claim 1 wherein the shoe shells are substantially hydrophobic.

3. The rowing shoe system of claim 1 wherein the shoe shells have greater rigidity than the shoe liners.

4. The rowing shoe system of claim 1 wherein the shoe shells have an opening of sufficient size to receive the shoe liners when on the rower's feet, the opening further including a securable closure to prevent removal of the shoe liners when on the rower's feet.

5. The rowing shoe system of claim 1 wherein the shoe shells are adjustable in size to accommodate shoe liners of different foot sizes.

6. The rowing shoe system of claim 1 wherein the shoe shells have a water-impermeable toe and top portions, and further including an adjustable heel portion to accommodate shoe liners of different foot sizes.

7. The rowing shoe system of claim 1 wherein the shoe shells have a one-piece sole.

8. The rowing shoe system of claim 1 wherein the shoe liners are impregnated with an antibacterial agent.

9. The rowing shoe system of claim 1 further including a plurality of pairs of shoe liners of different foot sizes.

10. A method of securing a rower's feet in a racing boat comprising:

providing a boat having a footboard and a pair of shoe shells each having a toe portion and a heel portion, each of the shoe shells being detachably secured near the toe portion to the footboard in a rowing position, the heel portion of each of the shoe shells being unsecured to the footboard and including an adjustment strap to accommodate shoe liners of different foot sizes, the shoe shells having an interior sized to receive a flexible shoe liners, the shoe shells having openings therein to ventilate the rower's feet;

providing a pair of shoe liners sized to receive the feet of a rower, the shoe liners having a flexible exterior surface and a flexible interior surface configured to fit over substantially the entire foot of the rower;

placing the shoe liners on the rower's feet;

inserting the rower's feet, with the shoe liners on, into the shoe shells; and adjusting the strap to the rower's foot size.

11. The method of claim 10 further including removing the rower's feet, with the shoe liners on, from the shoe shells; and removing the shoe liners from the rower's feet.

12. The method of claim 10 wherein the shoe shells are substantially hydrophobic, have a one-piece sole and have greater rigidity than the shoe liners.

13. The method of claim 10 wherein the shoe shells have an opening of sufficient size to receive the shoe liners when on the rower's feet, the opening further including a securable closure, and further including securing the closure after inserting the rower's feet into the shoe shells to prevent removal of the shoe liners when on the rower's feet.

14. The method of claim 10 wherein the shoe shells are adjustable in size, and further including adjusting the shoe shell to accommodate the rower's foot size after inserting the rower's feet into the shoe shells.

15. The method of claim 10 wherein the shoe shells have a one-piece sole.

16. The method of claim 10 wherein the shoe liners are impregnated with an antibacterial agent.

17. The method of claim 10 wherein the shoe liners have a slip-resistant exterior sole surface.

18. The method of claim 10 further including providing a plurality of pairs of shoe liners of different foot sizes, and selecting shoe liners of the rower's foot size prior to placing the shoe liners on the rower's feet.

* * * * *